US008061368B2

(12) United States Patent
Chudzik et al.

(10) Patent No.: US 8,061,368 B2
(45) **Date of Patent: *Nov. 22, 2011**

(54) HAIR HOLDER WITH ELASTIC FRICTION MEMBER

(75) Inventors: Stan Chudzik, Alpharetta, GA (US); Michael Defenbaugh, Marietta, GA (US); Emmie Henderson, Chamblee, GA (US); Sarah Kraft, Atlanta, GA (US); Catherine Schweers, Atlanta, GA (US); P. Chiu Lau, Hong Kong (CN)

(73) Assignee: Goody Products, Inc., Atlanta, GA (US)

( * ) Notice: Subject to any disclaimer, the term of this patent is extended or adjusted under 35 U.S.C. 154(b) by 545 days.

This patent is subject to a terminal disclaimer.

(21) Appl. No.: 11/548,601

(22) Filed: Oct. 11, 2006

(65) Prior Publication Data

US 2007/0084480 A1 Apr. 19, 2007

Related U.S. Application Data

(60) Provisional application No. 60/727,134, filed on Oct. 13, 2005.

(51) Int. Cl.
*A45D 8/00* (2006.01)

(52) U.S. Cl. ..... 132/273

(58) Field of Classification Search ..... 132/275, 132/273, 274, 212; 2/174

See application file for complete search history.

(56) References Cited

U.S. PATENT DOCUMENTS 1,066,759 A * 7/1913 Schloss ..... 87/2
2,825,328 A * 3/1958 Olsen ..... 606/204.15
5,156,171 A * 10/1992 Goodman ..... 132/200
5,230,355 A 7/1993 Weingrod ..... 132/275
5,301,696 A * 4/1994 Revson ..... 132/273

(Continued)

FOREIGN PATENT DOCUMENTS

CN 2810304 8/2006

(Continued)

OTHER PUBLICATIONS

English language translation of CN 2810304 published Aug. 30, 2006.

*Primary Examiner* — Todd Manahan
*Assistant Examiner* — Brianne O'Neill
(74) *Attorney, Agent, or Firm* — Lempia Summerfield Katz LLC

(57) ABSTRACT

The invention is directed to a pony tail holder including a friction member for more effectively engaging the strands of hair in the pony tail to prevent slippage of the pony tail holder during use. The pony tail holder may include a fabric ring having an annular area at least a portion of which comprises a tubular annulus around a central hole in which a pony tail is to be gripped by the pony tail holder, and an elastic core disposed within the tubular annulus of the fabric ring and extending around the central hole. The pony tail holder may further include a friction member woven into the fabric ring proximate an inner edge of the fabric ring such that at least a portion of the friction member is exposed through the outer surface of the fabric ring and engages the pony tail when the pony tail holder is disposed thereon, with the coefficient of friction of the friction member being greater than the coefficient of friction of the outer surface of the fabric ring.

13 Claims, 7 Drawing Sheets

U.S. PATENT DOCUMENTS

| | | | | |
|---|---|---|---|---|
| 5,379,782 | A | 1/1995 | Tabb | 132/275 |
| D356,393 | S | 3/1995 | Revson | D28/41 |
| 5,758,671 | A | 6/1998 | Thim | 132/273 |
| 5,826,598 | A | 10/1998 | Meehan | 132/275 |
| 5,947,129 | A | 9/1999 | Bradshaw | 132/54 |
| 6,000,408 | A | 12/1999 | Maturaporn | 132/273 |
| 6,024,103 | A * | 2/2000 | Hansbury | 132/275 |
| 6,799,581 | B2 * | 10/2004 | Cave | 132/273 |
| 6,895,601 | B2 * | 5/2005 | Park | 2/181 |
| 7,305,996 | B2 | 12/2007 | Kraft et al. | |
| 2004/0065341 | A1 | 4/2004 | La Fauci | |
| 2010/0017942 | A9 | 1/2010 | Schweers et al. | |

FOREIGN PATENT DOCUMENTS

| | | | |
|---|---|---|---|
| GB | 2318500 | * | 4/1998 |
| JP | 339874 | * | 9/2003 |

* cited by examiner

HAIR HOLDER WITH ELASTIC FRICTION MEMBER

REFERENCE TO RELATED APPLICATION

This application claims priority from Provisional Application Ser. No. 60/727,134, filed on Oct. 13, 2005, which is expressly incorporated by reference herein.

TECHNICAL FIELD

The present disclosure relates generally to a pony tail holder for retaining strands of hair and, more particularly, to a pony tail holder generally known as a scrunchie including a friction member for more effectively retaining the strands of hair.

BACKGROUND OF THE DISCLOSURE

Pony tail holders and scruchies in particular are generally know in the art, and typically include an elastic core that is covered by a cloth or other material. Upon restriction of the elastic core on the strands of hair, the cloth or material bunches around the strands of hair.

One such example is described in U.S. Pat. No. 5,156,171 which discloses a pony tail holder having a relatively wide fabric ring having a tubular annulus around a central hole. An elastic ring is disposed in the tubular annulus and includes a portion that is readily grasped, such as a knob or bead. By pulling the elastic ring outside of the fabric ring, the elastic ring can encircle and grip the pony tail separately from the tubular annulus.

In another example, U.S. Pat. No. 5,301,696 discloses a decorative pony tail holder for securely holding the hair of a user. The pony tail holder includes a band of elastic material with fabric surrounding the band and forming a plurality of radial projections extending circumferentially around a portion of the band. The pony tail holder may thus be secured to the hair by twisting the elastic band into a generally figure-eight configuration and folding it over itself to provide a tight band securing the hair with the radial projections extending circumferentially around the held hair of the user.

These pony tail holders or scrunchie-type devices have opportunities for improvement. For example, because of the fabric that surrounds the elastic core, the strands of hair have contact with the cloth portion of the holder which may provide less than optimal frictional engagement between the hair and holder to prevent the holder from slipping from the hair in certain situations. Similarly, because of the large amount the cloth that is being bunched between the hair and the elastic core, the retaining force of the elastic compresses the cloth in addition to retaining the hair.

SUMMARY OF THE DISCLOSURE

In one aspect, the invention is directed to a pony tail holder. The pony tail holder may include a fabric ring having an annular area at least a portion of which comprises a tubular annulus around a central hole in which a pony tail is to be gripped by the pony tail holder, and an elastic core disposed within the tubular annulus of the fabric ring and extending around the central hole. The pony tail holder may further include a friction member woven into the fabric ring proximate an inner edge of the fabric ring such that at least a portion of the friction member is exposed through the outer surface of the fabric ring and engages the pony tail when the pony tail holder is disposed thereon, with the coefficient of friction of the friction member being greater than the coefficient of friction of the outer surface of the fabric ring.

In another aspect, the invention is directed to a pony tail holder for securely holding a bundle of hair of a user. The pony tail holder may include a core of elastic material defining a central opening, and a fabric ring having an annular area at least a portion of which comprises a tubular annulus around a central hole in which the bundle of hair is to be gripped by the pony tail holder, with the fabric ring having the core disposed therein. The pony tail holder may further include a friction member woven into the fabric ring proximate an inner edge of the fabric ring such that at least a portion of the friction member is exposed through the outer surface of the fabric ring and engages the bundle of hair when the pony tail holder is disposed thereon, with the coefficient of friction of the friction member being greater than the coefficient of friction of the outer surface of the fabric ring.

In a further aspect, the invention is directed to a pony tail holder including a fabric ring having an annular area at least a portion of which comprises a tubular annulus around a central hole in which a pony tail is to be gripped by the pony tail holder, and an elastic band. The elastic band may include an elongate elastic core comprising a continuous loop, a sheath surrounding the elongate elastic core and having an outer surface, and a friction member woven into the sheath such that at least a portion of the friction member is exposed through the outer surface of the sheath. The elastic band is attached to the fabric ring along an inner edge of the fabric ring defining the central hole about the entire circumference of the central hole such that at least a portion of the friction member engages the pony tail when the pony tail holder is disposed thereon. Further, the coefficient of friction of the friction member is greater than the coefficient of friction of the outer surface of the sheath.

Figure 1:
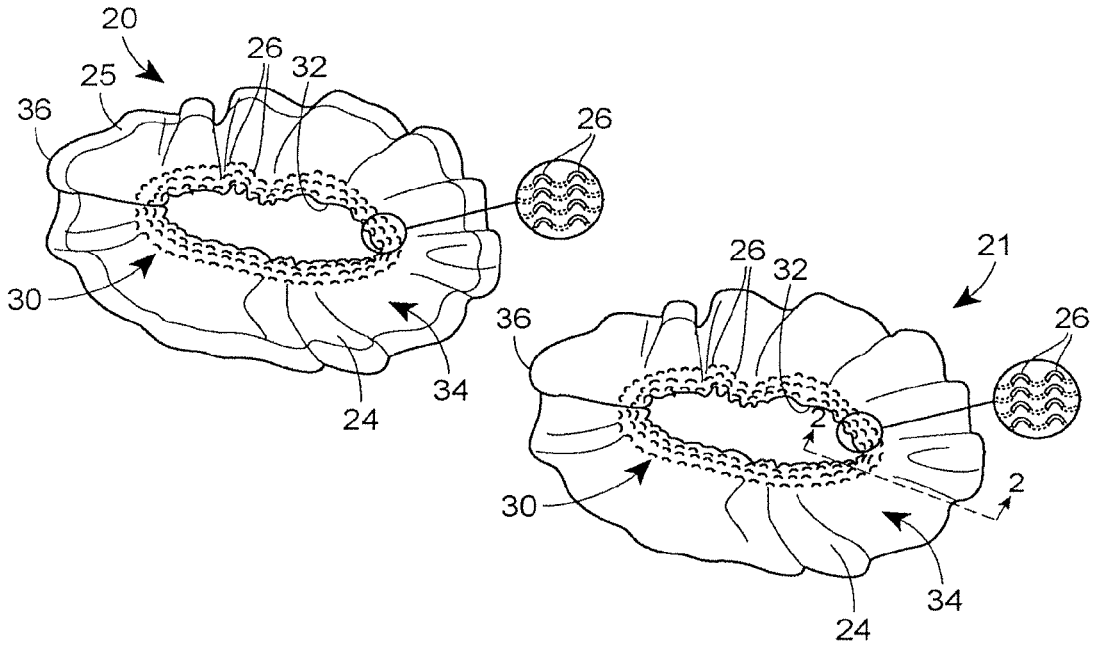
FIG. 1 is an isometric view of a pair of hair holders according to one embodiment of the disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 2:
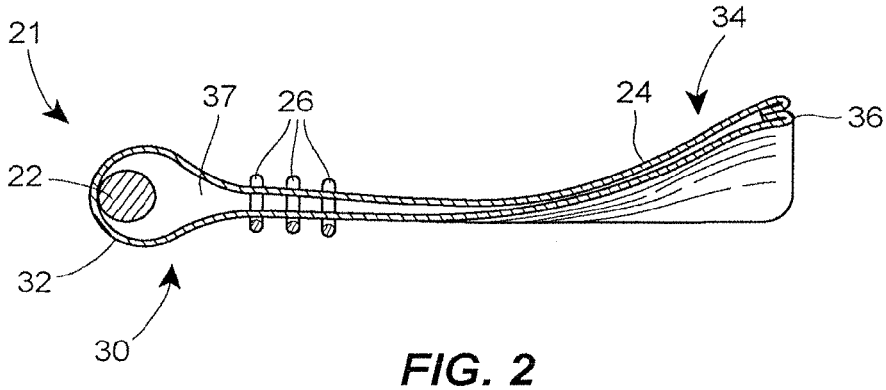
FIG. 2 is a cross-sectional view of the hair holder along line 2-2 of FIG. 1.

Referring now to the drawings, and with specific reference to FIGS. 1 and 2, pony tail holders constructed in accordance with the teachings of the disclosure are generally depicted by reference numerals 20 and 21. As illustrated in FIG. 1, the pony tail holders 20 and 21 in this exemplary embodiment each include an elastic ring or core 22 (FIG. 2) covered by a fabric ring 24, and one or more friction members 26 partially exposed through the outer surface of the fabric ring 24. The pony tail holders 20 and 21 may have the same general construction as scrunchie-type pony tail holders known in the art, such as those taught in U.S. Pat. No. 5,156,171, entitled "Method of Adorning a Pony Tail and Pony Tail Holder," and U.S. Pat. No. 5,301,696, entitled "Decorative Pony Tail Holder and Method of Using," the entire disclosures of which are expressly incorporated herein by reference for all purposes.

The core 22 of the pony tail holder 20 may be an elongate core 22 that is constructed from an elastic material, such rubber, plastic, natural rubber, silicone, or other elastic or visco elastic materials. The core 22 may form a continuous loop, but may also contain breaks therebetween. Similarly, the core 22 may be constructed from one single piece of elastic material formed as a loop or with opposite ends attached to form a loop, but may also be constructed from a plurality of pieces that may be connected in any known manner. The core 22 may have a generally round cross-sectional area, as seen in FIG. 2, but may have other cross-sectional shapes, such as rectangular, oval, square, triangular, etc.

The ring 24 of the pony tail holder 20, as seen in FIGS. 1 and 2, may be an elongate ring 24 that is constructed from materials including but not limited to plastic, paper, cloth, and elastic materials, or may be constructed from any material that does not result in excessive adhesion of the material of the ring 24 to the strands of hair. The ring 24 may be a woven material, or may be constructed from a non-woven material as well, and may be constructed such that the ring 24 can expand with the core 22 when the pony tail holder 20 is stretched. Moreover, the ring 24 may be fabricated from a single piece of fabric or other material that is folded and stitched or otherwise connected at the edges to form the ring 24 in a manner that encloses the core 22 therein. Alternatively, the ring 24 may be formed from multiple strips of fabric or material to form the annulus enclosing the core. For example, the ring 24 of the pony tail holder 20 includes an additional strip of material 25 attached about the outer edge of the ring 24 to seal the ring 24 and/or to enhance the appearance of the pony tail holder 20.

The ring 24 may surround the entire core 22 and, as such, may have a ring-like or annulus shape having an inner portion 30 defined at one end by an inner edge 32 of the ring 24 and an outer portion 34 defined at one end by an outer edge 36 of the ring 24. In this embodiment, the core 22 is disposed in a tubular annulus or hollow area 37 defined by the ring 24 (FIG. 2). In varying embodiments, the ring 24 may have a length of the inner edge 32 that is larger than the core 22, such that when the core 22 is in an extended state, the ring 24 is not taut. Alternatively, the ring 24 may be fabricated from an elastic material and, therefore, the inner edge 32 of the ring 24 may be closer in size to the core 22. As a result, the ring 24 may expand and contract with the core 22.

In order to improve the gripping force provided by the core 22 and the fabric ring 24 described above, the pony tail holders 20 and 21 further include one or more friction members 26 woven through the material of the ring 24 proximate the inner edges 32 of the pony tail holders 20 and 21. The friction members 26 may be constructed from a material that preferably has a higher friction coefficient than the material from which the ring 24 is constructed so that the frictional force at the points of contact with the hair about which the pony tail holders 20 and 21 are applied are greater between the hair and the friction members 26 than between the hair and the material from which the ring 24 is fabricated. The increased gripping force helps prevent excessive slippage of the pony tail holders 20 and 21 while they are worn, in particular during physical activities such as working out at a gym or running where the movements of the wearer may cause the pony tail holders to slide off the wearer's hair.

The friction member 26 may be constructed from materials including but not limited to plastic, rubber, natural rubber, silicone, or other elastic or visco elastic materials. The friction member 26 may form a continuous loop, but may also contain breaks there between. Similarly, the friction member 26 may be constructed from one single piece, or may alternatively be constructed from a plurality of pieces that may or may not be connected. The friction member 26 may have a round cross-sectional area, or may have other cross-sectional shapes, such as rectangular, oval, square, triangular, etc.

In the illustrated embodiment shown in FIGS. 1 and 2, one or more friction members 26 may be stitched, woven or otherwise disposed through the outer surface of the ring 24. In particular, the friction members 26 may be stitched through the material of the ring 24 in parallel rows on the inner portion 30 of the ring 24 proximate the inner edge 32, thereby forming a region of increased friction proximate the inner edge 32 of the ring 24. The core 22 may be disposed between adjacent rows of the friction members 26 or, as seen in FIG. 2, may be retained proximate the inner edge 32 of the ring 24 in the hollow area 37 defined by the inner edge 32 of the ring 24 and stitching formed by the inner-most friction member 26.

The pony tail holders 20 and 21 as disclosed herein may be disposed around objects, such as strands of hair. The pony tail holders 20 and 21 may be tightened by pulling a portion outwardly from the object, giving the extended portion a half twist, and pulling the object through the newly-formed loop. The process is repeated until the desire tension of the pony tail holder 20 or 21 around the object is achieved. In such an example, the friction member 26 may allow the pony tail holder 20 or 21 to obtain a better hold around the strands of hair such that during use the pony tail holder 20 or 21 is better able to resist sliding or movement relative to the bundle of hair. This result is further accomplished by placing the friction member 26 proximate the inner edge 32 of the ring 24 and near the elastic core 22, thereby ensuring that the friction member 26 does not loose contact with the stands of hair and retaining the core 22 proximate the inner edge 32. The core 22 may be fabricated from an elastomeric material and dimensioned such that the force or engagement of the pony tail holders 20 and 21 with the strands of hair is not so great as to cause excessive discomfort to the user by tugging the hair when the pony tail holders 20 and 21 are removed.

Figure 3:
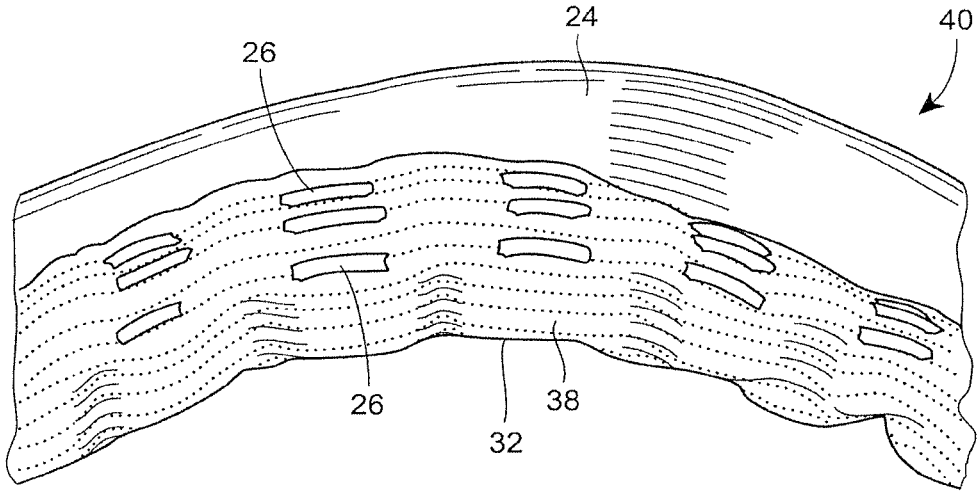
FIG. 3 is a perspective view of a portion of a second embodiment of a hair holder according to the disclosure.
Figure 4:
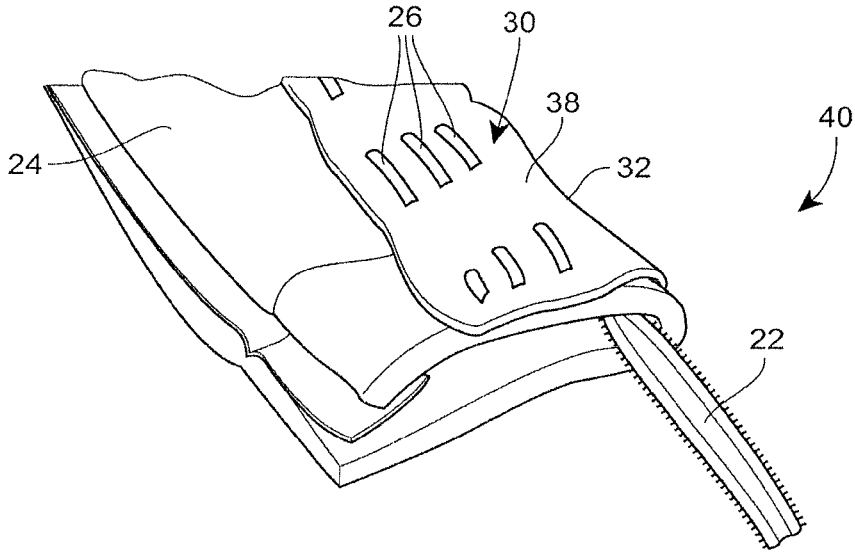
FIG. 4 is a perspective view of a portion of the hair holder of FIG. 3 cut to reveal the interior of the fabric pieces.

In another exemplary embodiment of the hair holder 20, shown in FIG. 3, all or at least a portion of the friction members 26 are disposed on a second piece or strip of material 38 or similar structure that forms a portion of the fabric ring 24 proximate the inner edge 32 of a pony tail holder 40. The second strip 38 may be constructed from the same or a different material as the remaining material forming the ring 24, and may include but is not limited to plastic, paper, cloth, and elastic material. In this embodiment, the friction members 26 are stitched, woven or otherwise disposed through or on the second strip 38, and then the second strip 38 is attached to the remaining fabric or material by stitching or other connection mechanism to form the ring 24. For example, as illustrated in FIG. 4, the ring 24 may be wrapped around the core 22 in a similar manner as the in the pony tail holders 20 and 21 such that the core 22 is disposed near the inner edge 32 of the ring 24. The second strip 38 is then straddled around the inner portion 30 and stitched, woven or otherwise attached to the ring 24. Preferably, the second strip 38 is attached to the ring 24 such that the core 22 is trapped near the inner edge 32 of the ring 24.

Figure 5:
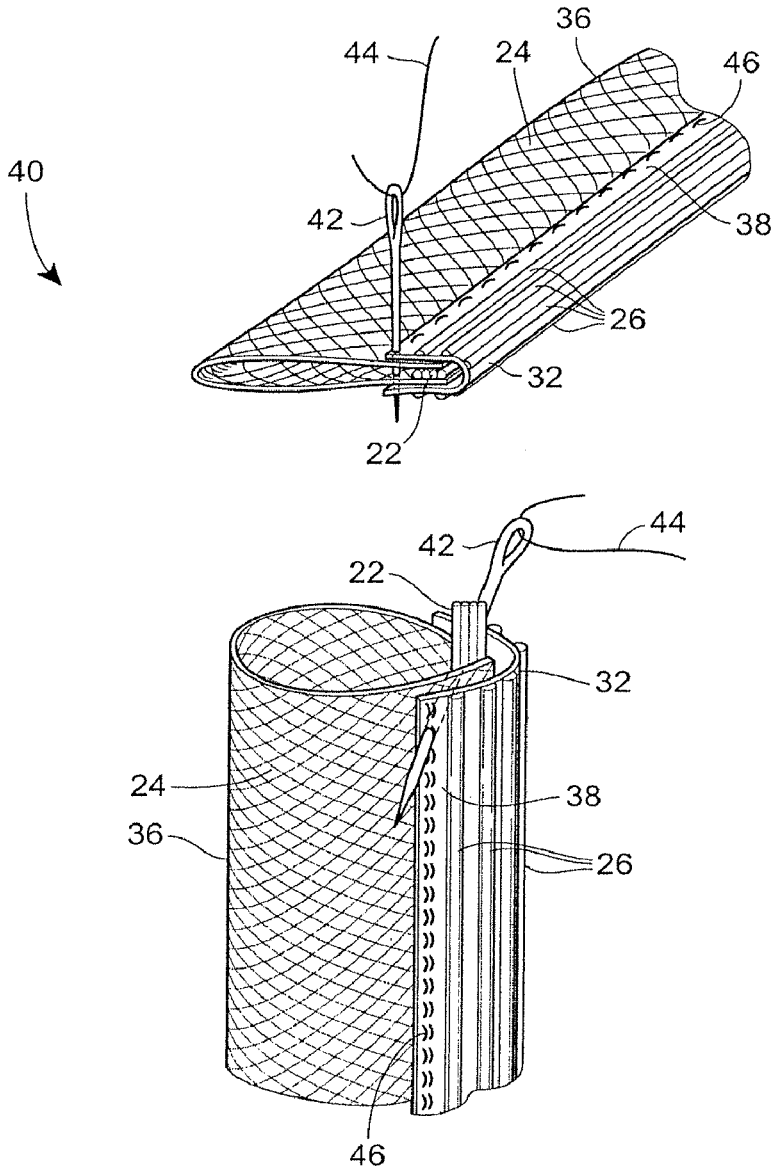
FIG. 5 is an isometric view of the hair holder of FIG. 3 during the fabrication process.

This embodiment of the pony tail holder 20 may be constructed in several manners, one of which is illustrated in FIG. 5. In this construction, the first strip of material forming the ring 24 is folded over and the core 22 is disposed along an open end between the edges of the material defining the inner edge 32 of the ring 24. The second strip 38 is then wrapped around the open end and sewn onto the ring 24 with a needle 42 such that the inner portion 30 is covered to form a tube of material, and the core 22 is trapped within the hollow area 37 between the second strip 38 and the stitches 46. The stitching 46 may be formed using thread 44 or, alternatively, by sewing in a further elastic member 26 through the second strip 38 and the fabric of the ring 24.

Figure 6:
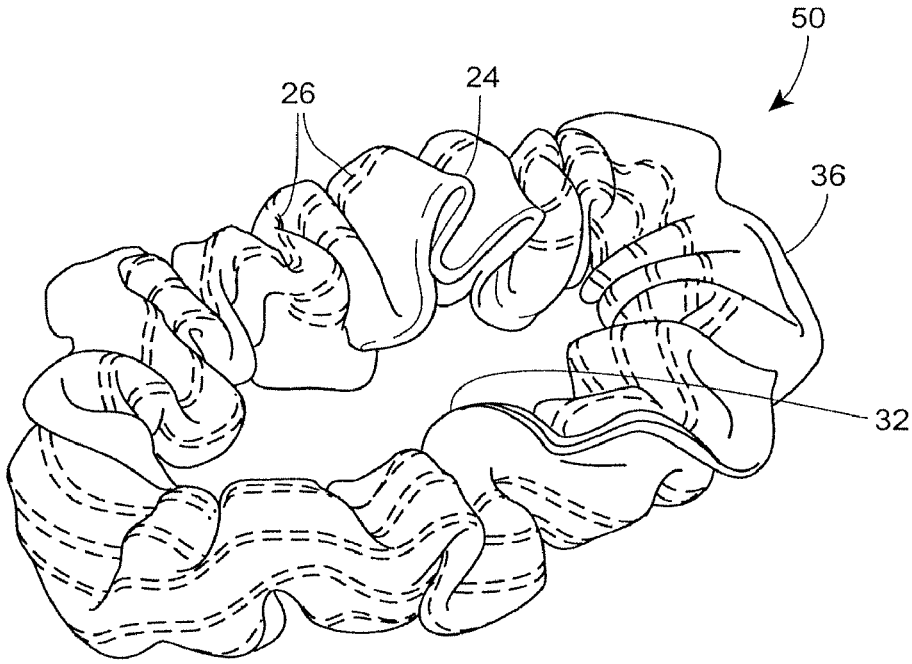
FIG. 6 is a perspective view of a third embodiment of a hair holder according to the disclosure.

In another alternative embodiment of a pony tail holder 50 illustrated in FIG. 6, one or more friction members 26 or sets of friction members 26 are woven into and are exposed through the outer surface of the material forming the ring 24. The friction members 26 may be disposed across a majority of the ring 24 between the inner edge 32 and the outer edge 36, and may be disposed at spaced about the outer surface of the ring 24 between the inner edge 32 and the outer edge 36. Depending on the construction of the pony tail holder 50, the core 22 may be retained proximate the inner edge 32 by stitching or other mechanism, or may be free to move within the ring 24. As such, regardless of the position of the core 22 (not shown) or the orientation of the ring 24 relative to the friction members 26, the friction members 26 engage the strands of hair and remain in contact to prevent slippage on the bundled stands of hair while worn by the wearer, even during the performance of physical activities.

Figure 7:
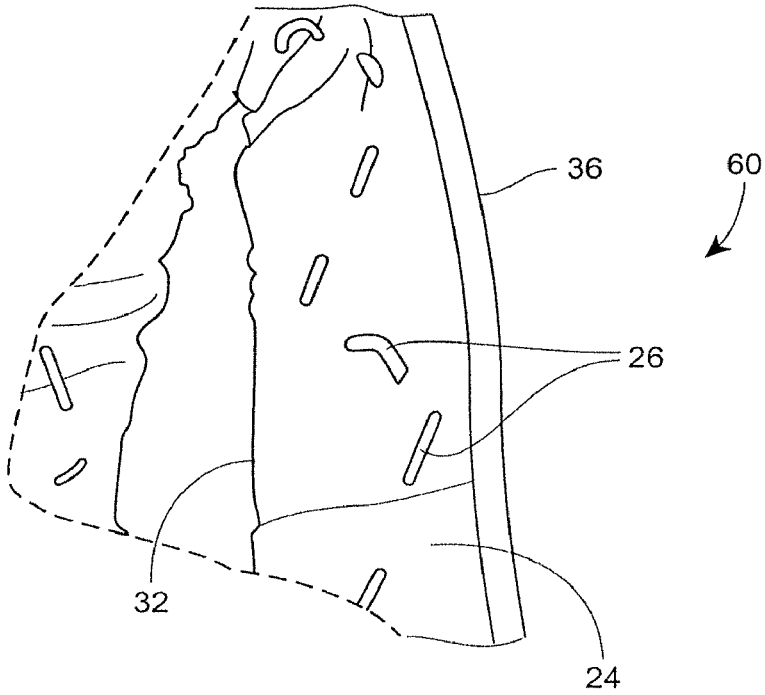
FIG. 7 is a perspective view of a portion of a hair holder according to a further embodiment the disclosure.

In a further alternative embodiment of a pony tail holder 60 shown in FIG. 7, one or more friction members 26 are stitched in a zig-zag pattern through the front and back of the ring 24 and around the entire circumference of the ring 24. The core 22 (not shown) in this embodiment may be retained by the friction member 26 near the inner edge 32 of the ring 24 without the need for additional stitching or retention.

Figure 8:
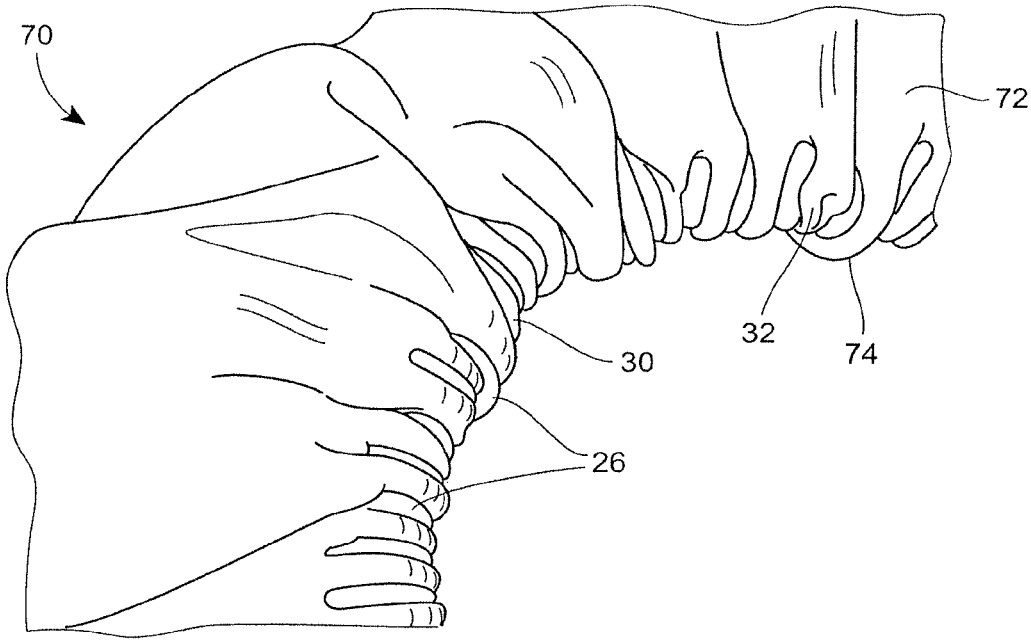
FIG. 8 is a perspective view of a portion of a hair holder in accordance with a still further embodiment.

FIG. 8 illustrates another alternative embodiment of the pony tail holder 70 wherein one or more friction members 26 are stitched or looped around the inner portion 30 of the ring 24. The friction member 26 may therefore enter a first side 72 of the ring 24 and be looped or spiraled around the inner edge 32 and through a second side 74 of the ring 24. In this embodiment, the core 22 (not shown) is retained by the loops of the friction member 26 near the inner edge 32 of the ring 24, and the core 22 forces the friction member(s) 26 into engagement with the strands of hair such that the friction member 26 does not loose contact with the strands of hair during use.

Figure 9:
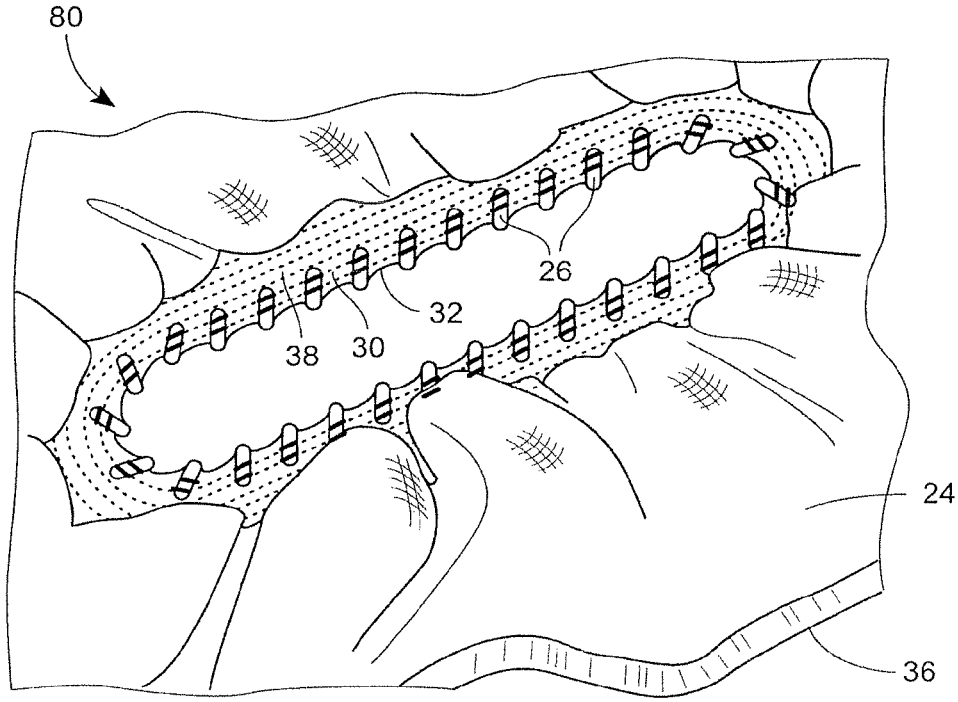
FIG. 9 is a perspective view of a portion of another embodiment of a hair holder according to the disclosure.

In a still further alternative embodiment of a pony tail holder 80 shown in FIG. 9, the friction member 26 is woven along with threaded material around the core 22 (not shown) to form a sheath 82, thereby providing an elastic band which is then attached to the inner edge 32 of the ring 24 defining the central hole of the pony tail holder 80 about the entire circumference of the central hole. Examples of an elastic core surrounded by a woven sheath incorporating friction members is provided in U.S. Patent Application Ser. Nos. 60/628,148 (filed Nov. 16, 2004) and 11/272,996 (filed Nov. 14, 2005), both entitled "Elastic Band," the entire disclosures of which are expressly incorporated herein by reference for all purposes. The elastic band may be attached to the ring 24 by sewing, weaving or otherwise attaching the sheath 82 or friction member 26 to the inner edge 32 of the ring 24. The friction member 26 in this embodiment is therefore part of the sheath 82 surrounding the core 22 and replaces one or more of the threads or bunches of threads in the weave forming the sheath 82. Alternatively, the friction member 26 may be an addition to the weave such that the friction member 26 does not replace any threads that create the sheath 82, but rather is simply disposed on the exterior of the previously woven sheath 82.

Figure 10:
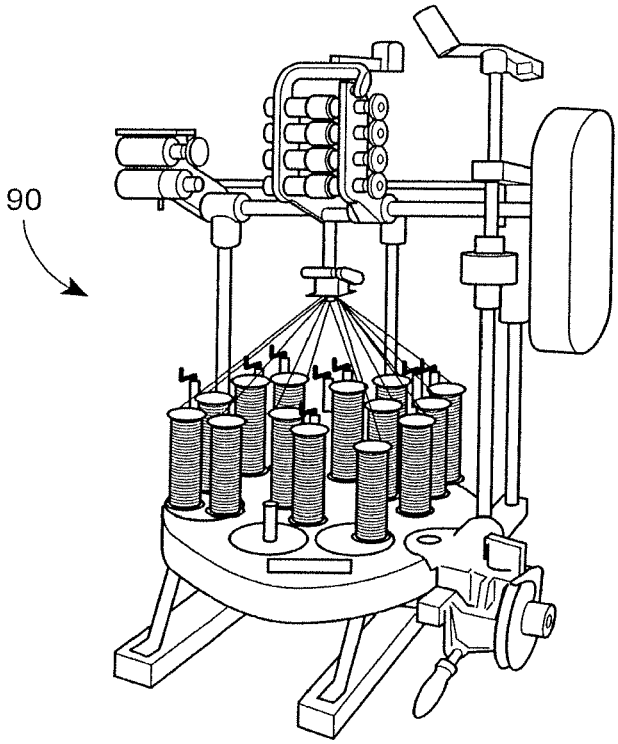
FIG. 10 is a perspective view of a maypole braiding system.

The sheath 82 may be manufactured using any known braiding or weaving system or method, including but not limited to, maypole braiding systems and flat braiding systems. A maypole braiding system 90, as seen in FIG. 10, forms strands or fabrics by an operation commonly known as braiding. Bobbins, or carriers having bobbins thereon, travel in predetermined paths. The carriers either pass each other so as to interlace the strands, or the strands leading from bobbins are caused to pass other bobbins to cause interlacing of the strands. A flat braiding system weaves three or more strands into a single braid by interlacing the strands longitudinally over one another. Additional information relating to this embodiment may be found in U.S. Patent Application 60/628,148, which is expressly incorporated herein by reference in its entirety for all purposes.

Figure 12:
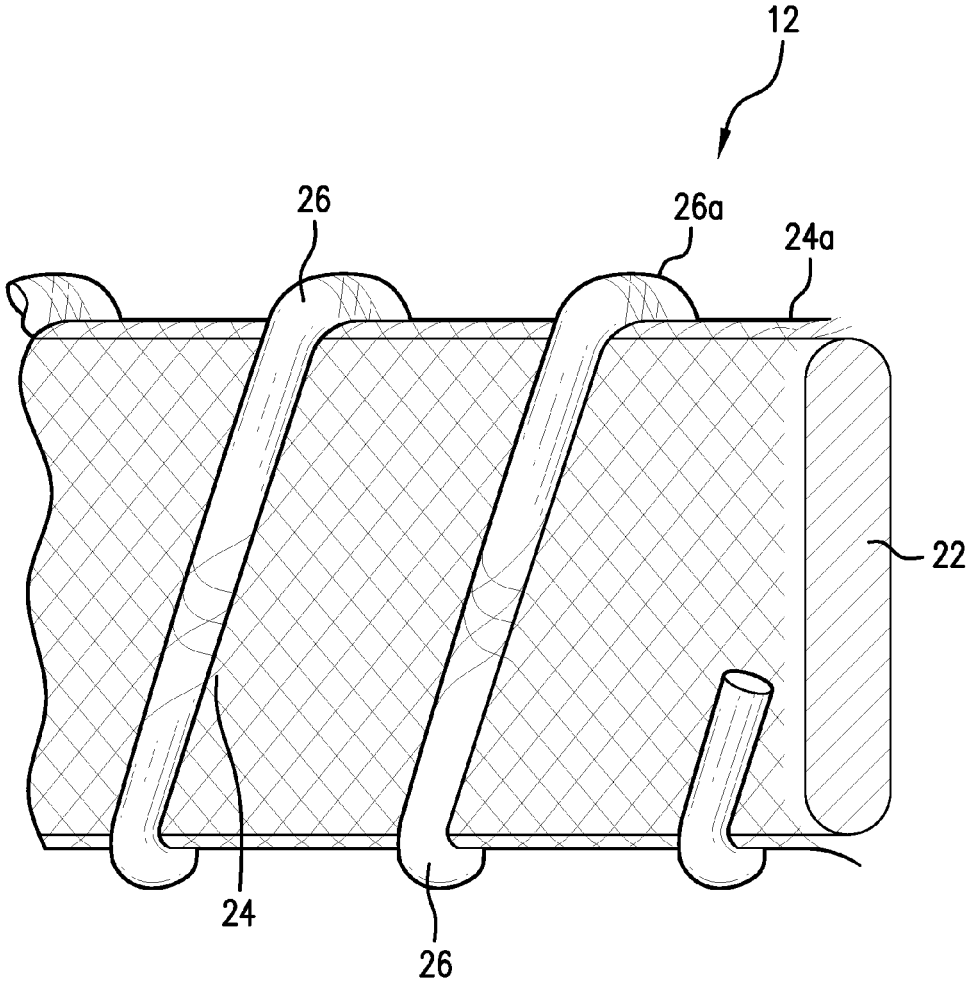
FIG. 12 is a perspective view of a gripping member portion of the hair holders of FIGS. 8 and 9.

The embodiments of FIGS. 8 and 9 include the gripping member 12 shown in FIG. 12. The elastic core 22 may be elongate and constructed from an elastic material, such rubber, plastic, natural rubber, silicone, or other elastic or visco-elastic materials. The sheath 24 may be elongate and constructed from a material, including but not limited to, plastic, paper, cloth, and elastic or visco-elastic materials, but could be any material that does not have excessive adhesion to the strands of hair. The sheath 24 may be a woven material, but may be constructed from a non-woven material as well, and may be constructed such that the sheath can expand with the core 22 when the gripping member 12 is stretched. The sheath 24 may be woven in a criss-cross pattern with the friction member 26 threaded or woven through the sheath. The friction member 26 may, in this exemplary embodiment, be part of the weave thereby replacing one or more of the threads or bunches of threads of the weave, as seen in FIG. 12, or may be an addition to the weave, such that the friction member is simply disposed between the previously woven sheath 24. The friction member 26 may be disposed at an outer surface of the sheath 24 such that additional threads or bundles of threads may be woven around the friction member 26 with portions of the friction member exposed through the outer surface of the sheath to the hair. The friction member 26 may be constructed from a material that preferably has a higher friction coefficient that the material of which the sheath 24 is constructed. For example, the friction member 26 may be constructed from a material including, but not limited, to plastic, rubber, natural rubber, silicone, or other elastic or visco-elastic materials. The friction member 26 may be woven into the sheath 24, as seen in FIG. 12, such that the friction member becomes part of the woven sheath. In one exemplary embodiment, an outer surface 26*a* of the friction member 26 may extend outwardly from an outer surface 24*a* of the sheath 24 such that the friction member 26 may contact the hair. Additionally, the outer surface 26*a* of the friction member 26 may abut the core 22, as can be seen in FIG. 12. As such, a cross-sectional area of the friction member 26 may be larger, or substantially larger, than a cross-sectional area of the material of which the woven sheath 24 is constructed, thereby ensuring that at least a part of the friction member contacts the hair.

The frictional thread 26 may be wrapped in a helical pattern around the elastic core 22, as seen in FIG. 12. The gripping member 12 may be formed as an integral component of the pony tail holder by using the fabric annulus at the inner edge of the ring as the sheath 24, which is wrapped around the core 22 and into which the gripping thread 26 is woven (see FIGS. 8 and 9). Alternatively, the gripping member 12 may be separately assembled and then attached (e.g., sewn) onto the inner edge of the fabric ring.

The above exemplary embodiments may include many variations thereof to achieve and/or create additional or alternative features. For example, the friction member 26 may be attached to the pony tail holders 20, 40, 50, 60, 70, 80 in alternate ways, including but not limited to gluing the friction member 26 to the pony tail holders, such as with hot melt glue or cyanoacrylate glue, and stitching the friction member 26 to the sheath 82 or ring 24. The adhesive can be applied at intervals along the length of the product to allow the stretch properties required for use to remain intact.

Figure 11:
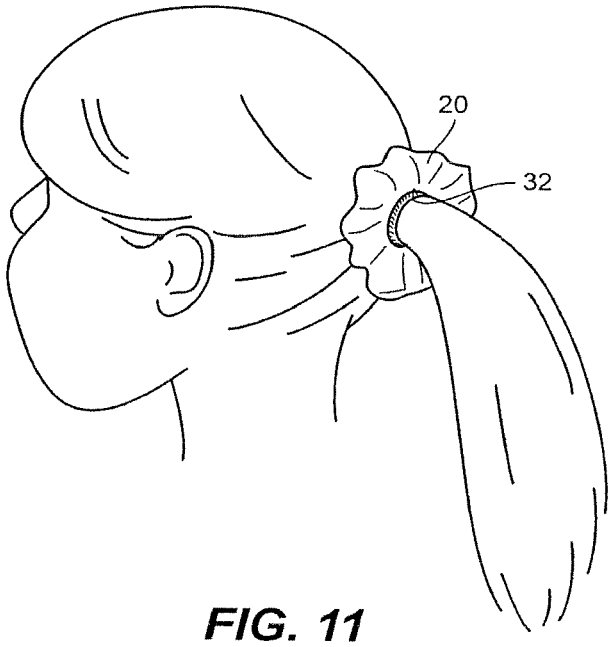
FIG. 11 is a perspective view of a user wearing a hair holder in accordance with the present disclosure.

In operation, the user may dispose one of the embodiments of the pony tail holder 20, 40, 50, 60 70, 80 around any variety of objects. For example, as seen in FIG. 11, the pony tail holder 20 may be disposed around a bundle of hair to hold and retain the same. The user may twist the pony tail holder 20 into one or more of loops in a figure-eight configuration until the user achieves a desired inner edge 32 or a desired amount tension in the core 22 of the pony tail holder 20. The user need not, however, twist the pony tail holder 20 prior to disposing the pony tail holder 20 around the bundle of hair, but may achieve the desired inner edge 32 or the desired tension anytime during the use of the pony tail holder 20. Once the desired inner edge 32 or the desired amount of tension has been achieved, the user may thread the bundle of hair through the inner edge 32 of the pony tail holder 20 or, conversely, may expand the pony tail holder 20 around the bundle of hair.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A pony tail holder, comprising:

a ring made of a sheet of material forming a tubular annulus and an inner edge defining a central hole in which a pony tail is to be gripped by the pony tail holder; and a gripping member positioned circumferentially around the central hole at the inner edge to grip the pony tail extending through the central hole, the gripping member comprising:

a sheath at least partially formed by the sheet of material, including the inner edge, and forming the tubular annulus;

an elastic core disposed in a loop within the tubular annulus of the sheath and extending circumferentially all the way around the central hole; and an elongate, elastic friction member woven through the sheath, including through the inner edge of the ring, such that portions of the friction member are exposed through an outer surface of the sheath and engage the pony tail when the pony tail holder is disposed thereon, wherein the coefficient of friction of the friction member is greater than the coefficient of friction of the outer surface of the sheath so that the exposed portions of the friction member grip the bundle of hair to secure the pony tail holder thereon, wherein the friction member is woven through the sheath and wound around the sheath and the elastic core in a helical pattern around the entire circumference of the inner edge of the ring so that the exposed portions of the friction member extend inwardly beyond the outer surface of the inner edge of the sheath into the central hole and grip the pony tail inserted through the central hole, wherein the elastic core is retained by loops of the friction member near the inner edge of the ring.

2. The pony tail holder of claim 1, wherein the ring is constructed from a single piece of material.

3. The pony tail holder of claim 1, wherein the ring comprises an inner piece of material forming the sheath and having the friction member woven therethrough, and an outer piece of material stitched to the inner piece of material to define the tubular annulus of the fabric ring.

4. The pony tail holder of claim 3, wherein the elastic core is disposed within the inner piece of material.

5. The pony tail holder of claim 1, wherein the core is constructed from at least one of a rubber, plastic, natural rubber, and silicone material.

6. The pony tail holder of claim 1, wherein the sheet material of the ring is a woven fabric material.

7. The pony tail holder of claim 1, wherein the friction member is constructed from at least one of a rubber, plastic, natural rubber, and silicone material.

8. The pony tail holder of claim 1, wherein the friction member is woven into the sheath.

9. The pony tail holder of claim 1, wherein the ring is woven of a plurality of threads and the friction member is woven or threaded into the woven ring such that the friction member replaces one or more of the ring threads and, together with the threads, forms the ring.

10. A pony tail holder, comprising:

a ring made of a sheet of woven fabric material forming a tubular annulus and an inner edge defining a central hole in which a pony tail is to be gripped by the pony tail holder; and a gripping member positioned circumferentially around the central hole at the inner edge to grip the pony tail extending through the central hole, the gripping member comprising:

a sheath at least partially formed by the sheet of material, including the inner edge, and forming the tubular annulus;

an elastic core disposed in a loop within the tubular annulus of the fabric sheath and extending circumferentially all the way around the central hole, wherein the core is constructed from at least one of a rubber, plastic, natural rubber, and silicone material; and an elongate, elastic friction member woven through the fabric sheath, including proximate the inner edge of the fabric ring, such that portions of the friction member are exposed through an outer surface of the fabric sheath and engage the pony tail when the pony tail holder is disposed thereon, wherein the coefficient of friction of the friction member is greater than the coefficient of friction of the outer surface of the fabric ring so that the exposed portions of the friction member grip the bundle of hair to secure the pony tail holder thereon, wherein the friction member is woven through the fabric sheath and wound around the fabric sheath and the elastic core in a helical pattern around the entire circumference of the inner edge of the fabric ring so that the exposed portions of the friction member extend inwardly beyond the outer surface of the inner edge of the fabric sheath into the central hole and grip the pony tail inserted through the central hole, wherein the friction member is constructed from at least one of a rubber, plastic, natural rubber, and silicone material, and wherein the ring is woven of a plurality of threads and the friction member is woven or threaded into the woven sheath such that the friction member replaces one or more of the sheath threads and, together with the threads, forms the sheath, wherein the elastic core is retained by loops of the friction member near the inner edge of the ring.

11. The pony tail holder of claim 10, wherein the ring is constructed from a single piece of material.

12. The pony tail holder of claim 10, wherein the ring comprises an inner piece of material forming the sheath and having the friction member woven therethrough, and an outer piece of material stitched to the inner piece of material to define the tubular annulus of the fabric ring.

13. The pony tail holder of claim 12, wherein the elastic core is disposed within the inner piece of material.

* * * * *